US007445063B2

(12) United States Patent
Holmgren

(10) Patent No.: US 7,445,063 B2
(45) Date of Patent: Nov. 4, 2008

(54) ROCK DRILL BIT ASSEMBLY

(75) Inventor: Lars Holmgren, Sala (SE)

(73) Assignee: Atlas Copco Secoroc AB, Fagersta (SE)

( * ) Notice: Subject to any disclaimer, the term of this patent is extended or adjusted under 35 U.S.C. 154(b) by 0 days.

(21) Appl. No.: 10/553,795

(22) PCT Filed: Apr. 7, 2004

(86) PCT No.: PCT/SE2004/000551

§ 371 (c)(1),
(2), (4) Date: Jun. 12, 2006

(87) PCT Pub. No.: WO2004/094772

PCT Pub. Date: Nov. 4, 2004

(65) Prior Publication Data

US 2007/0175664 A1 Aug. 2, 2007

(30) Foreign Application Priority Data

Apr. 22, 2003 (SE) ..... 0301167

(51) Int. Cl.
*E21B 10/38* (2006.01)

(52) U.S. Cl. ..... 175/376; 175/344

(58) Field of Classification Search ..... 175/376, 175/344

See application file for complete search history.

(56) References Cited

U.S. PATENT DOCUMENTS 839,837 A * 1/1907 Guttziet ..... 175/333
1,747,908 A * 2/1930 Seifert ..... 175/334

* cited by examiner

*Primary Examiner*—Giovanna Collins Wright
*Assistant Examiner*—John Kreck
(74) *Attorney, Agent, or Firm*—Young & Thompson

(57) ABSTRACT

A drill bit assembly for direct removal of rock with a rotatable bit assembly (5) that includes a plurality of cutters or choppers (7). According to the invention, an number of cutters (7) are so disposed in relation to each other or the bit assembly (5) that a subsequent cutter (7*b*), seen in the direction of rotation, will engage an edge created by the action of preceding cutter (7*a*).

10 Claims, 3 Drawing Sheets

ROCK DRILL BIT ASSEMBLY

BACKGROUND OF THE INVENTION

The present invention relates to a rock drill bit assembly, and then particularly to a rock drill bit assembly that comprises a number of so-called rock cutters or chopping bits mounted on a reamer or drum for working in rock or stone. When drilling in rock, particularly with regard to drilling large holes, such as when reaming holes or in the case of production hole drilling, where parts of the rock shall be broken loose, it is important that engagement with the rock to be worked is as effective as possible. It is well known that all species of rock differ significantly from one another with regard to their mechanical strength, depending on whether the rock is subjected to a pressure force or a pulling force. These differences may be in the order of more than ten times.

If an attempt is made to chop loose the largest possible volume of rock or stone from a rectangular block with the aid of a sledgehammer and chisel, it will soon become apparent that the most effective way is to commence adjacent one edge of the block and strike the chisel obliquely outwards towards the edge.

DESCRIPTION OF THE RELATED ART

Equipment that utilises this principle is also available commercially. The principle according to which such equipment works is illustrated in FIG. 1. Such equipment, however, has a relatively low efficacy.

SUMMARY OF THE INVENTION

Accordingly, one object of the invention is to provide a novel rock working bit assembly with which highly effective reaming or production hole drilling can be achieved, such as to enable large quantities of rock to be effectively broken away.

This object is achieved by means of an inventive bit assembly with which a number of cutters or choppers are mounted rotatably on a bit assembly, said cutters being disposed relative to one another in their direction of rotation such that subsequent cutters, or choppers, will engage an edge that has been formed when cutting away rock with the aid of a preceding cutter.

The cutters are conveniently disposed along one or more helical lines on the upper side of the reamer. By "reamer" is meant a tool for reaming, widening, drilled holes, where the reamer is drawn upwards as it rotates.

In the case of a bit assembly in the form of a cylindrical drum, the cutters are conveniently disposed along one or more helical lines on the outer surface of the drum.

BRIEF DESCRIPTION OF THE DRAWINGS

The invention will now be described in more detail with reference to two non-limiting embodiments and also with reference to the accompanying drawings, in which.

DESCRIPTION OF THE PREFERRED EMBODIMENT

Figure 1A:
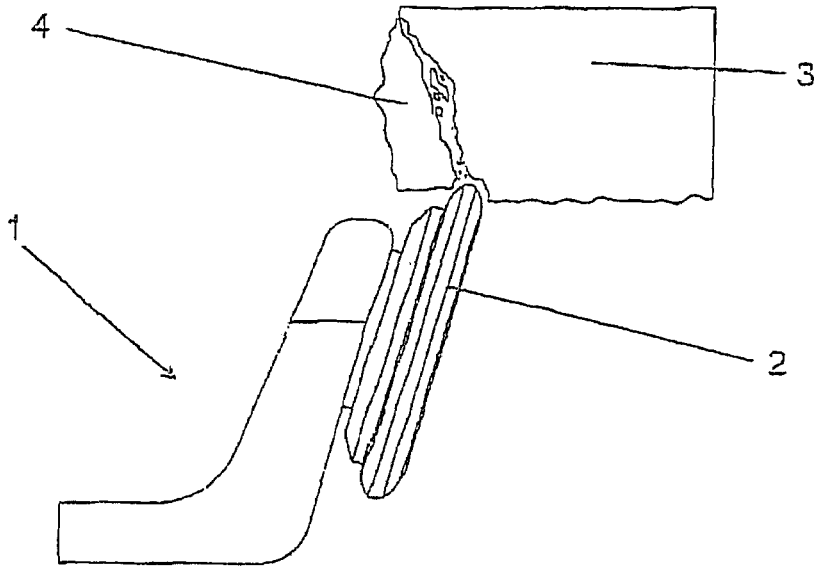
PRIOR ART Fig. 1a
FIG. 1*a* and FIG. 1*b* illustrate respectively the principles according to which a rotating bit assembly acts against the edge of a rock body.
Figure 1B:
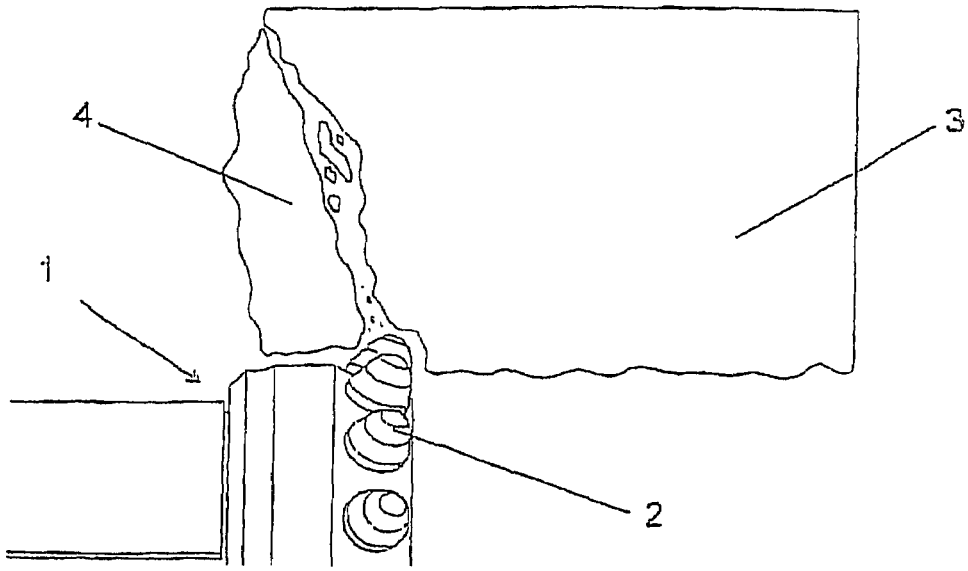
PRIOR ART Fig. 1b

FIGS. 1*a* and 1*b* illustrate the basic principle of breaking Loose rock fragments. A rotatable bit assembly 1 includes one or more disc-shaped cutters or choppers 2, which may have the form of obliquely positioned steel discs (FIG. 1*a*) or discs provided with hardmetal pins on their periphery (FIG. 1*b*) and mounted around the periphery of the rotatable bit assembly. The bit assembly 1 is controlled so that the choppers 2 will engage the rock 3 close to its edge, such that the impact forces exerted by the choppers 2 on the rock are directed obliquely upwards in the rock 3, so as to enable fragments 4 of the rock to be broken loose. Thus, it is intended that the impact forces applied to the rock 3 by the disc-shaped chopper 2 will generate cracks that reach to a free edge of the rock therewith enabling a fragment of rock to be broken loose.

The inventive bit assembly is intended to work in accordance with the same principle, although on a much larger scale and with the aid of a plurality of co-acting, force-applying tools.

Figure 2:
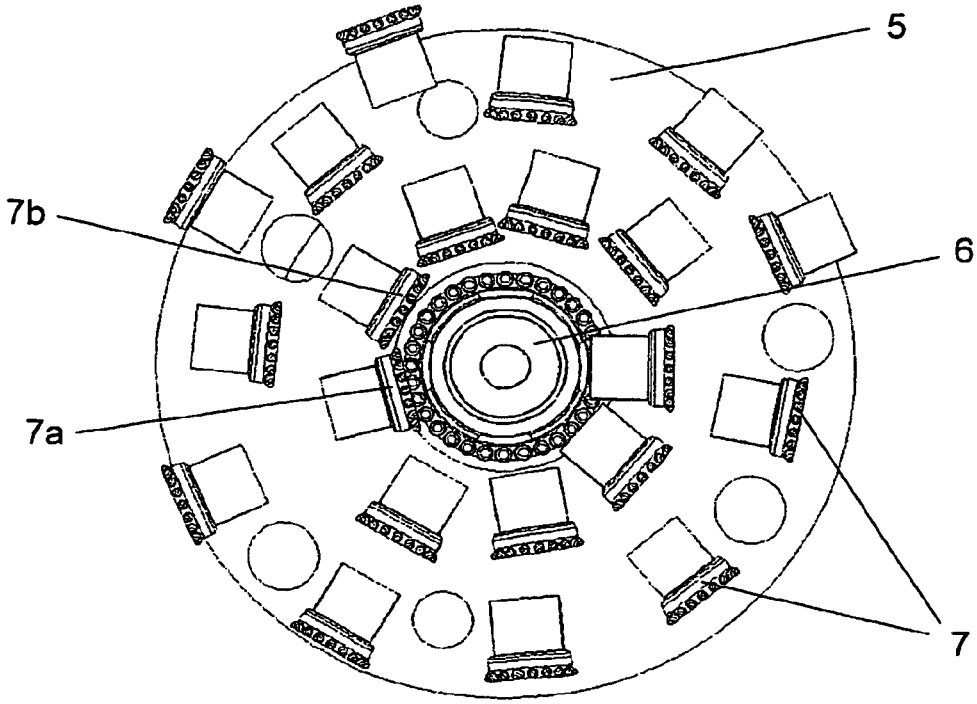
FIG. 2 is a plan view of a reamer that includes a plurality of rock cutters or choppers mounted in accordance with the invention.
Figure 3:
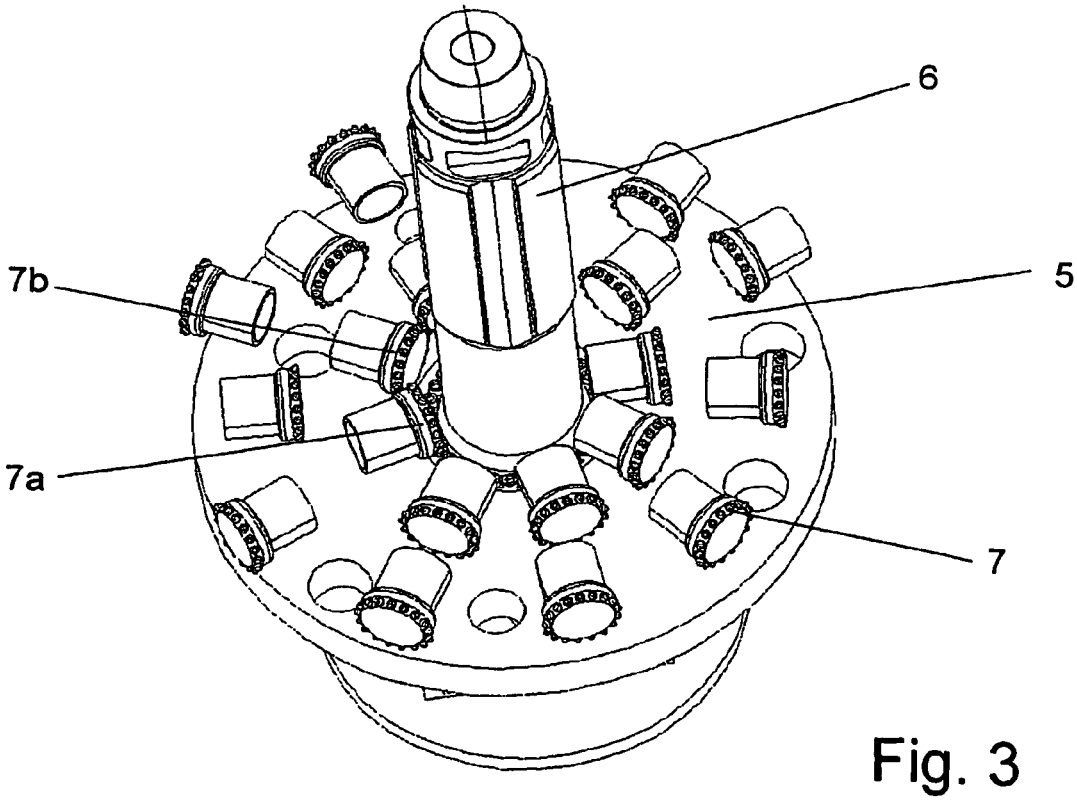
FIG. 3 illustrates the reamer of FIG. 2 schematically and in perspective.

FIGS. 2 and 3 illustrate a reamer 5 used to widen or ream a drilled hole. The reamer 5 is carried by a centrally positioned rod, stinger, 6, which projects into a pre-drilled pilot hole and with the aid of which the reamer 5 is rotated about its axis and drawn upwards against the overlying rock and therewith cut rock away. The rock is worked by means of a number of choppers or cutters 7 disposed on the upper side of the reamer 5. In order to ensure that the reamer 5 will cut the rock as effectively as possible, the cutters 7 are disposed relative to each other such that a subsequent cutter 7*b*, as seen in the direction of rotation, will engage an edge formed by the cutting action of a preceding cutter 7*a*. In the illustrated case, the reamer 5 is rotated anti-clockwise and the first cutter that comes into engagement with the edge of a predrilled pilot hole is the cutter 7*a* situated furthest in towards the centre. As the reamer 5 rotates and the first cutter 7*a* breaks loose a rock fragment, there is created a fresh break edge with which the next cutter in the cutter sequence, i.e. the cutter 7*b*, comes into engagement and can break loose a fresh fragment, whereafter the next cutter 7*c* in line engages the fresh break edge, and so on.

The cutters 7 are preferably disposed along a helical line con the upper surface of the reamer 5, as shown in FIGS. 2 and 3. The cutters are therewith disposed relative to one another so that mutually sequential cutters will engage an edge formed with the aid of the cutting or fragmenting action of a preceding cutter. It is also conceivable to position the cutters along more than one helical line.

Figure 4:
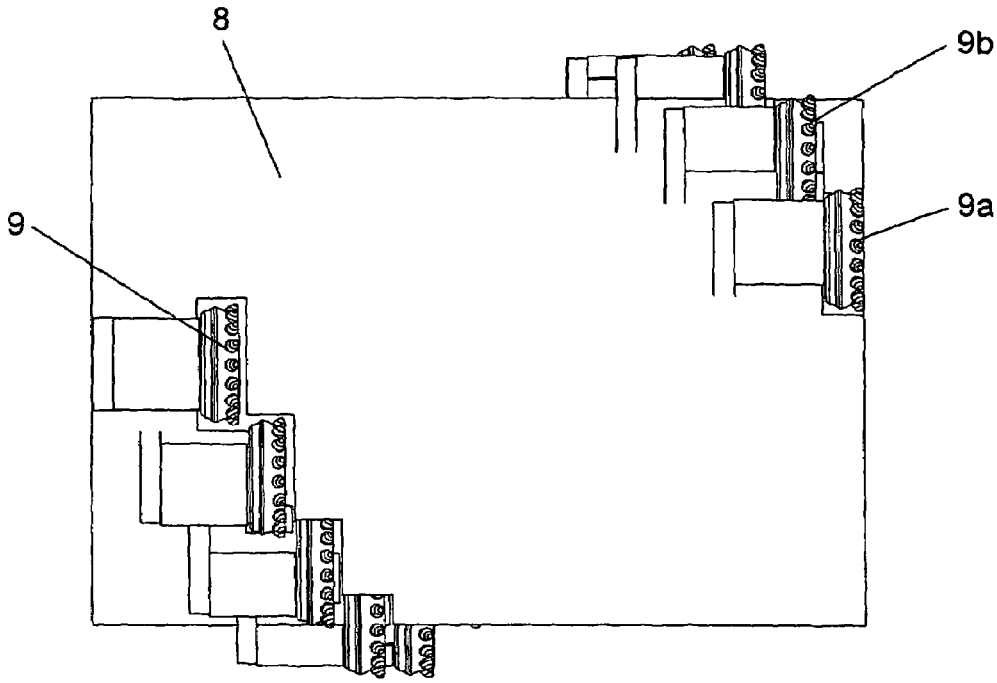
FIG. 4 is a side view of a cylindrical drum that has a plurality of cutters mounted in accordance with the invention.
Figure 5:
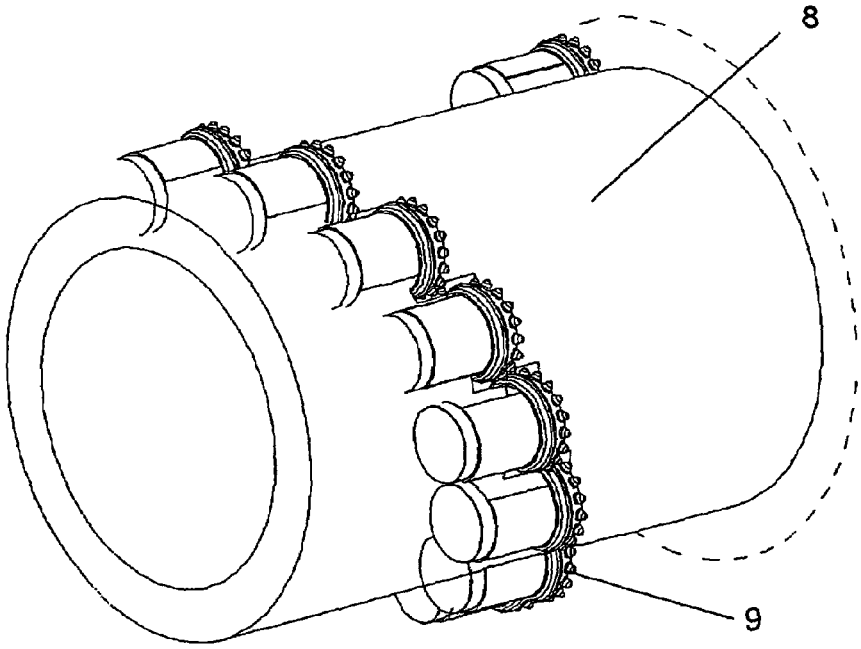
FIG. 5 is a perspective view of the drum shown in FIG. 4.

The invention can also be applied with other types of bit assemblies, such as with cylindrical drums 8 as shown in FIGS. 4 and 5. These cylindrical drums 8 are provided on their respective barrel surfaces with a large number of cutters 9 which are disposed relative to one another such that subsequent cutters 9*b*, as seen in the rotational direction of the drum, will engage an edge created by the cutting or fragmenting action of a preceding cutter 9*a*. As will be seen from the figures, the cutters 9 are disposed along a helical line extending on the outer barrel surface of the cylindrical drum 8. This fulfils the basic cutter positioning requirement, namely that the cutters are so disposed relative to one another that a subsequent cutter 9*b*, as seen in the direction of rotation, will engage an edge created by the cutting or fragmenting action of a preceding cutter 9*a*. It is also possible in this case to place the cutters along more than one helical line on the cylindrical drum.

Cylindrical drums 8 provided with cutters 9 disposed in accordance with the invention are used conveniently for production hole drilling. The drum 8 carrying the cutters is rotated and, at the same time, moved laterally through the rock body being worked, therewith breaking loose the rock in the absence of blasting requirements. By arranging cutters that are disposed in relation to each other on a bit assembly in accordance with the invention so that a subsequent cutter, seen in the direction of rotation, will engage an edge created by the action of a preceding cutter provides a highly effective arrangement for direct rock cutting and rock breaking arrangement.

It will be understood that the inventive drill bit assembly can also be used with other types of bit assemblies than the two arrangements described by way of example in the aforegoing.

The invention claimed is:

1. A drill bit assembly for direct removal of rock, comprising:

a rotatable bit assembly (5; 8) having a center point (6);

plural cutters (7; 9) included in said assembly and disposed at different distances from the center point, said cutters (7; 9) disposed in relation to each other so that a subsequent cutter, seen in the direction of rotation, will engage an edge created by the action of a preceding cutter.

2. A drill bit assembly according to claim 1, wherein the bit assembly comprises a reamer (5) and cutters disposed on the surface of said reamer, a first of said cutters disposed at a first diameter from the center point and a second of said cutters disposed at a second diameter from the center point.

3. A drill bit assembly according to claim 2, wherein the cutters (7) are mounted along one or more helical lines on the surface of the reamer (5).

4. A drill bit assembly according to claim 1, wherein the bit assembly is comprised of a cylindrical drum (8) and cutters (9) disposed on the outer barrel surface of the drum (8).

5. A drill bit assembly according to claim 4, wherein the cutters (9) are disposed along one or more helical lines on the drum surface.

6. A drill bit assembly of claim 1, wherein the cutters are choppers.

7. A drill bit assembly according to claim 1, wherein, the bit assembly comprises a reamer (5) having a stinger (6) at the center point, and the cutters are disposed on the surface of said reamer with each adjacent cutter being at a increasing distance from the stinger.

8. A drill bit assembly, comprising:

a reamer (5) configured to widen-ream a drilled hole and having an axis and an upper side;

a centrally positioned stinger (6) carrying the reamer, the stinger to project into a predrilled pilot hole and rotate the reamer about the reamer axis for being drawn upwards against overlying rock to therewith cut rock away; and plural cutters (7) disposed on the upper side of the reamer at first and second diameters from the stinger, the cutters disposed relative to each other such that a subsequent cutter is at the first diameter and, as seen in a direction of rotation, will engage an edge formed by the cutting action of a preceding cutter at the second diameter, the second diameter being greater than the first diameter, wherein, with the reamer rotated anti-clockwise a first cutter that comes into engagement with an edge of a predrilled pilot hole is the preceding cutter (7*a*) situated at the second diameter, and as the reamer rotates and the first cutter (7*a*) breaks loose a rock fragment which creates a fresh break edge with which the subsequent cutter (7*b*) at the first diameter, comes into engagement and breaks loose a fresh fragment.

9. The drill bit assembly of claim 8, wherein the cutters are disposed along a helical line on the upper surface of the reamer.

10. A drill bit assembly, comprising:

cylindrical drums (8) configured to widen-ream a drilled hole and having an axis and a barrel surface; and plural cutters (7) disposed along a helical line extending on the outer barrel surface of the cylindrical drum, wherein, the cutters are disposed relative to one another that a subsequent cutter (9*b*), as seen in the direction of rotation, will engage an edge created by cutting of a preceding cutter (9*a*).

* * * * *